United States Patent [19]

Page

[11] 3,947,986

[45] Apr. 6, 1976

[54] ADVERTISING AND EMERGENCY SIGN

[76] Inventor: Charles M. Page, Rte. 1, Box 514, Azle, Tex. 76020

[22] Filed: Mar. 26, 1975

[21] Appl. No.: 514,478

[52] U.S. Cl. ..... 40/67; 40/132 R; 340/277; 340/376

[51] Int. Cl.[2] ..... G09F 13/00

[58] Field of Search ..... 40/132 R, 130 R, 67, 52 R, 40/52 A, 130 L, 78.11, 78.13, 78.15, 78.05, 104.03–104.07, 102; 340/277, 376, 366 A, 366 G, 366 E; 312/242, 245

[56] References Cited

UNITED STATES PATENTS

| | | | |
|---|---|---|---|
| 1,404,295 | 1/1922 | Horvitz | 340/277 X |
| 1,500,706 | 7/1924 | Isom | 340/376 X |
| 1,964,353 | 6/1934 | Hodos | 340/277 |
| 2,518,979 | 8/1950 | Davidson | 340/277 |
| 2,803,810 | 8/1957 | Evans et al. | 340/277 X |
| 3,251,638 | 5/1966 | Schwartz | 312/245 X |

*Primary Examiner*—Hugh R. Chamblee
*Assistant Examiner*—John F. Pitrelli
*Attorney, Agent, or Firm*—James C. Fails

[57] ABSTRACT

Advertising and emergency sign characterized by a supported sign that has exterior illumination for night viewing and includes a central framework and two facade sides disposed one on each side and being adapted, when released, to fall away from the central framework to expose an interior message board having an emergency message thereon. The interior message board is illuminated by an interior illumination inside the central framework. The facade sides are retained in place normally, but are released by a remote switch, such as disposed inside a store or the like for closing in the event of an emergency, such as a robbery. Also disclosed are specific preferred structural embodiments, such as the hingedly mounted opaque facade sides and the flashing interior illumination for calling attention to the emergency message.

7 Claims, 3 Drawing Figures

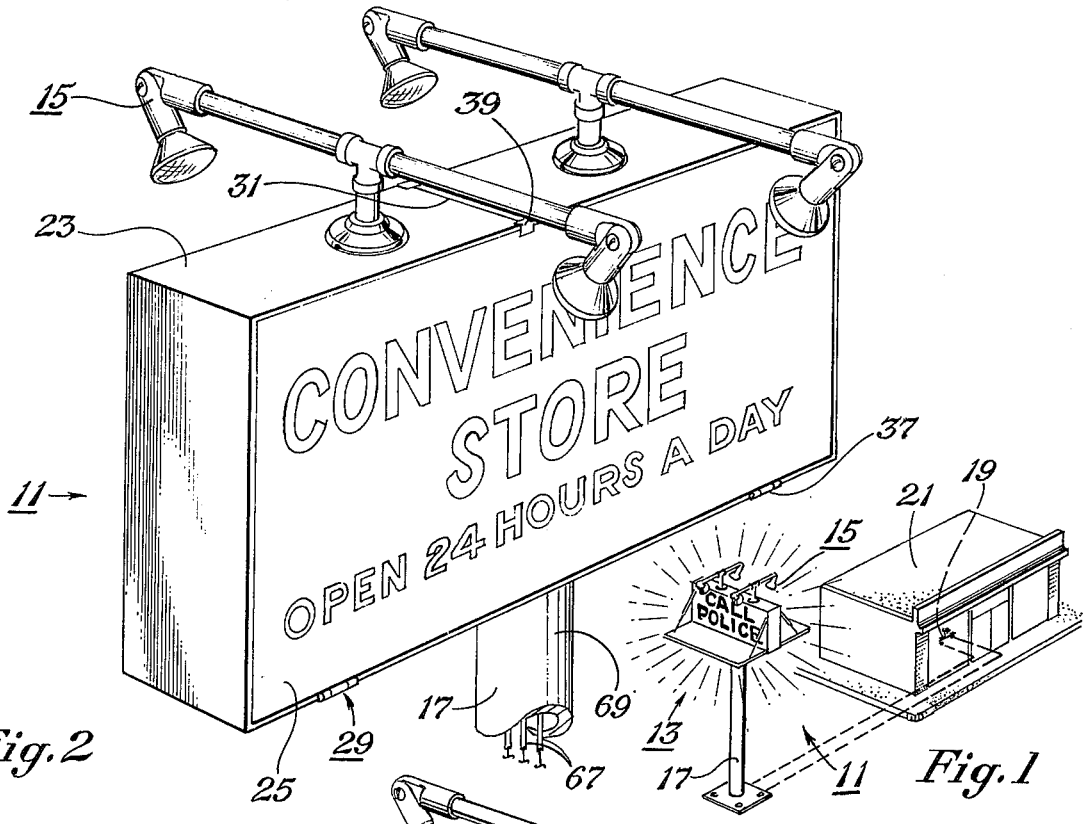
Fig. 2
Fig. 1
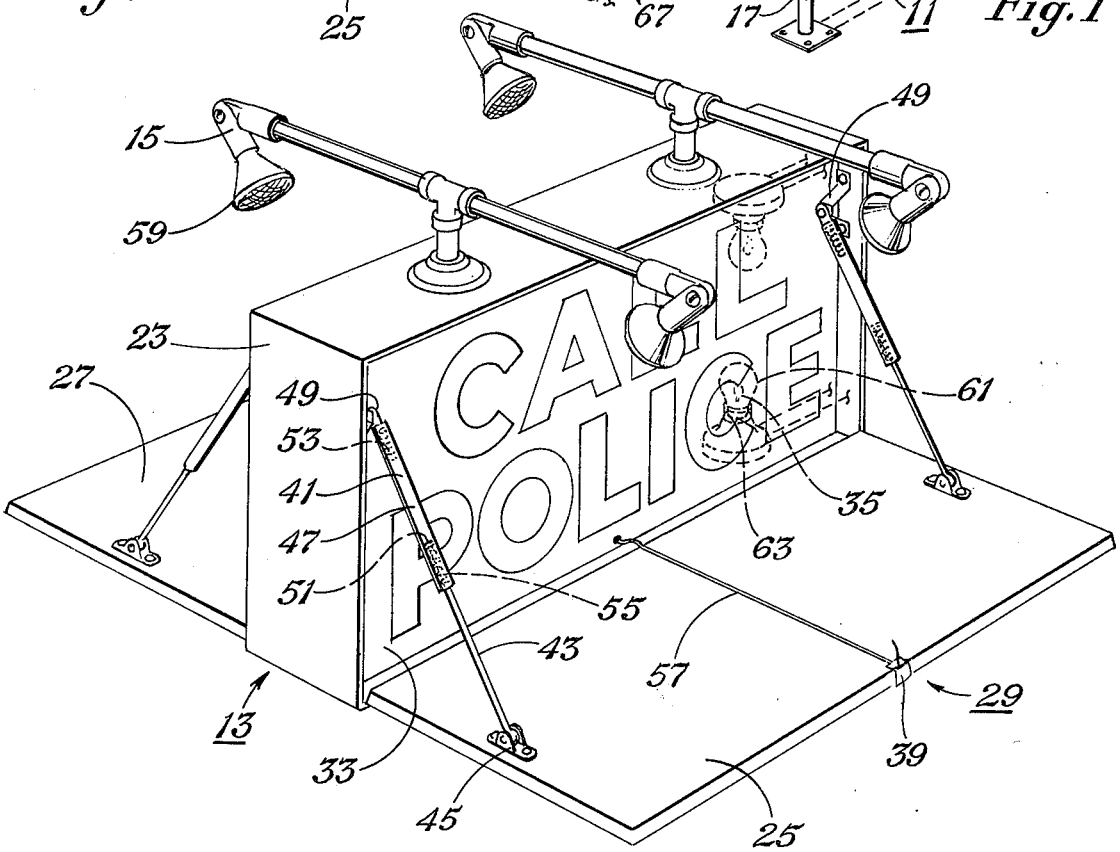
Fig. 3

ADVERTISING AND EMERGENCY SIGN

BACKGROUND OF THE INVENTION

1. Field of the Invention

This invention relates to advertising and emergency signs. More particularly, it relates to signs that can be employed for conventional advertising; and can be converted electrically, remotely and silently into a device for summoning aid, for preventing successful completion of a robbery, or the like, without endangering lives.

2. Description of the Prior Art

The prior art has seen a wide variety of different types of signs and a wide variety of different types of aid summoning and anti-robbery devices. Ordinarily, the two have not been combined. The aid summoning and anti-robbery devices have been heretofore divided into two primary categories. These categories are the direct aid summoning and the indirect aid summoning devices. The indirect aid summoning devices usually take the form of burglar alarms and the like that are activated to cause an audio alarm; such as, a siren, or loud bells; that seeks aid from a passerby, either directly or by calling the police. These sound producing alarms have almost always caused anger in the robber. This anger was frequently vented on the clerks or other persons in the store. Many times this has resulted in their being killed before the robber would flee. If a passerby attempted to intervene directly, there was danger to the passerby's life.

The direct aid summoning devices have been inordinately expensive, since they required an interconnection into a police station or the like. Consequently, they have been economically infeasible for the smaller business establishments, such as small retail stores.

From the foregoing it can be seen that the prior art has failed to produce a combination sign and aid summoning or anti-robbery device that could be employed silently without danger to lives of innocent personnel; yet was economical enough to be affordable by the smaller business establishments.

SUMMARY OF THE INVENTION

Accordingly, it is an object of this invention to obviate the disadvantages of the prior art and provide a combination sign that can be employed for advertising and can be converted into an aid summoning and anti-robbery device remotely, silently and safely without endangering the lives of innocent persons.

Specifically, it is an object of this invention to provide an advertising sign that may be converted silently into a flashing sign to get the passerby to summon aid, yet not alert the robber until he would be on the outside of a store, thereby allowing clerks time to seek protection before the robber became aware that aid was being summoned.

These and other objects will become apparent from the descriptive matter hereinafter, particularly when taken in conjunction with the appended drawings.

In accordance with this invention there is provided an advertising and emergency sign device that will also double as an aid summoning or anti-robbery device, and includes a supported sign having an exterior illumination means for illuminating the sign in the normal configuration for viewing at night. The sign is disposed so as to be readily seen by passersby. It includes a central framework and two facade sides disposed one on each side so as to be visible in a normal configuration. The facade sides are adapted, when released, to fall away from the central framework sufficiently to expose an interior message board that is disposed within the central framework. Retainer means are provided for retaining the sides connected with the central framework, at least in the normal position. Release means are provided for releasing at least one edge of the respective facade sides to allow the facade sides to fall away to expose the interior message board upon closure of a switch disposed remotely from the sign. For example, the switch may be disposed interiorly of a store so as to be closed in the event of an emergency, such as a robbery in progress. The sign includes an interior message board that has displayed on respective sides an emergency message asking the passerby to summon aid; and interior illumination means for illuminating the interior message board following release of the facade sides. Preferably, flashing interior illumination means are employed in order to draw the passerby's attention to the message on the interior message board. In this way, the facade sides can be released to fall away, as by pivoting about a hinge means, and expose the interior message board silently so as not to endanger persons' lives in the event of a robbery or the like.

BRIEF DESCRIPTION OF THE DRAWINGS

FIG. 1 is a perspective view of one embodiment of this invention.

FIG. 2 is a perspective view of the sign of FIG. 1 in a normal configuration.

FIG. 3 is a perspective view of the sign of FIG. 1 in an emergency configuration, exposing an inner message board.

DESCRIPTION OF PREFERRED EMBODIMENTS

Referring to FIGS. 1–3, the advertising and emergency sign device 11 includes a sign, per se, 13, exterior illumination means 15, support 17, and switch means 19 for closing in the event of an emergency inside a store 21 or the like.

The sign 13 is disposed so as to be readily seen by passersby. It includes a central framework 23, FIGS. 2 and 3, and two facade sides 25 and 27. The sign 13 also includes retainer means 29 for retaining the sides 25 and 27 connected with the central framework 23 and release means 31 for releasing at least one edge of the respective facade sides 25 and 27 to allow them to fall away to expose an interior, or inner, message board 33, FIG. 3. The sign 13 also includes interior illumination means 35 for illuminating the interior message board to call attention of the passersby to its message.

The specific illustrated embodiment of this invention will be described immediately hereinafter and thereafter related to the generic elements and sub-combinations delineated hereinbefore. The illustrated embodiment includes a rectangular sign with rectangular sides 25 and 27 that are opaque. Specifically, the sides 25 and 27 comprise 8 foot × 4 foot × ½ inch plywood sides with a normal advertising message on the exterior of the sides. The sides 25 and 27 are hingedly mounted to the central framework 23 with two each 2-inch hinges 37, FIG. 2. The central framework 23 comprises 2 inch × 6 inch lumber. The top of the respective sides 25 and 27 are held in the normal position illustrated in FIG. 2 by respective latching clips 39 and a fusible link, or wire, 31 serving as the release means.

The latching clips 39 serve as a vehicle for connecting the fusible wire 31 with a large conductor 57; that, in turn, connects with a switch 19 for melting the fusible wire 31 when the switch 19 is closed. Specifically, the fusible wire 31 may comprise number 20 wire that is wired taut from latching clip 39 to latching clip 39 on the respective sides 25 and 27. Thus, the small wire will be directly shorted with 115 volt current upon closure of the switch 19 and melted for allowing the sides 25 and 27 to fall away.

Connected intermediate the sides 25 and 27 and the central framework 23 are respective shock absorbers 41 for initiating pivotal outward movement of the respective sides 25 and 27 and for cushioning the shock of the sides falling completely open. Specifically, respective plunger shafts 43 are connected with the sides 25 and 27 by way of mounting brackets 45. Each cylinder 47 of each shock absorber 41 is connected with the central framework 23 by way of a mounting bracket 49. As is conventional, each plunger 43 has an interiorly disposed piston 51 that slows movement by a controlled flow of fluid therearound interiorly of the cylinder 47. Disposed at at least the upper end of the cylinder 47 are respective springs 53 for initiating the outward movement of the top end of the sides when released, as by melting of the fusible wire 31. If desired, a spring 55 may also be employed at the lower end to cushion the reaching of the lower limit of travel of the piston 51 as the sides fall open. Specifically, the spring 53 is compressed by the piston 51 when the sides are closed such that it serves as a biasing means for imparting initial outward motion of the top ends of the sides 25 and 27 to expose the inner message board 33.

The inner message board 33 has the desired letters formed in its sides for providing the message when the facade sides 25 and 27 fall away. As illustrated, the letters are CALL POLICE with four of the letters CALL being disposed on top and six of the letters POLICE being disposed on the bottom. There are two sides to the inner message board, each having the same message. As illustrated, the letters CALL POLICE are 1 foot high openings that are cut through the sides of the inner message board. The letters have amber glass thereover and respective lights 61 therebehind. Specifically, the respective lights 61, each having a flasher, is mounted, as on a 2 inch × 4 inch member traversing laterally interiorly of the inner message board, so as to be disposed behind its respective letter. Each of the lights are connected serially with the switch 19 so that closure of the switch energizes the lights. The lights are, in turn, flashed by respective flashers 63 for more clearly calling attention of the passerby to the emergency or aid-summoning message.

The flood lights 59 are connected via suitable conduits and conductors with a conventional switch for illuminating the facade sides 25 and 27 in the normal position for normal advertising. Any suitable lights, with or without reflectors and lenses, and inverted or otherwise disposed, may be employed in accordance with conventional practice.

Conductors for the respective electrical needs, illustrated as conductor 67, FIG. 2, traverse through the 5 inch tubular steel pole 69 serving as the support 17. The conductors 67 may comprise number 10 wire and run underground to the store 21 in conventional fashion, to be operated by one or more switches within the store. If desired, of course, the exterior illumination means may be turned on by a photocell or other light sensitive device in accordance with conventional practice.

As illustrated, the sign 13 is maintained at the desired height by the pole 17. Conventional 115 volt wiring is employed.

In operation, the sign 13 has the usual advertising message displayed in the normal position, as illustrated in FIG. 2. In the event there is an emergency, as in a robbery in progress, a clerk in the store closes switch 19, as by depressing a foot push button switch. The closure of switch 19 short circuits the fusible wire 31, melting it. Consequently, the top portion of the sides 25 and 27 are released and outward motion is initiated by the compressed spring 53 in the shock absorber 41. In any event, the facade sides 25 and 27 fall away to expose the inner message board 33 with its message CALL POLICE. As soon as the fusible wire 31 is short circuited and melted, the full 115 volts becomes available to illuminate the interior illumination means, such as the lights 61, by way of flashers 63. The respective flashers behind the lights 61 add urgency to the message and call the attention of the passersby to the emergency message. In theory, the passerby will see the sign and go to a phone and call the police such that the police can arrive on the scene to catch the burglar after he has left the store. As the robber leaves the store, the clerical personnel and others in the store may seek refuge behind suitable counters, in store rooms and the like; automatically closing the locks on the doors by suitable solenoid operated locks or the like to prevent reentry by the robbers. Thus, the robbers are not able to kill the employees as they would if an audio alarm were sounded while they were in the store.

From the foregoing, it can be seen that this invention provides an advertising and emergency sign that can serve as an anti-robbery device safely without endangering lives of personnel.

General considerations and the interrelationship of the generic elements and sub-assemblies and the specifically delineated elements are as follows.

While the facade sides have been described hereinbefore as being opaque and formed of wood, since the exterior illumination means serves to illuminate them from the outside; the sides may be of any of the conventional forms; such as, metal, plastic or the like.

On the other hand, the exterior illumination means may be actually disposed interiorly of the sign, as are conventional neon tubes, if the facade sides are translucent; such as, formed of plastic with colored or opaque letters thereon. The object of the exterior illumination means is to illuminate the facade sides 25 and 27 and the term "exterior" does not refer to placement of the lighting means, per se.

Similarly, the interior illumination means is provided for illuminating the interior message board. The interior illumination means need not be placed interiorly of the inner message board, but may be so positioned as to illuminate and call attention of the passerby to the interior message board after the facade sides 25 and 27 have fallen away.

From the foregoing discussion, it can be seen that the retainer means 29 comprises the hinges 37 and the latching clip 39 for retaining the sides connected with the central framework. It is relatively immaterial whether or not the sides are hingedly mounted or merely connected via suitable members to prevent them falling completely away to endanger passersby.

The retainer means ordinarily will include respective limit means to limit the movement of the sides 25 and 27. Such a limit means comprises the shock absorber 41 which limits the degree of pivotal movement of the sides in the illustrated embodiment. If desired, any conventional limit means; such as mechanical stops, suitable lineal member like flexible nylon cords; could be employed for one or more portions of the respective retainer means.

In the illustrated embodiment, the spring 53 in the top part of the shock absorber 41 serves as a biasing means for forcing initial movement of the sides to effect the falling away when the release means has been energized by closure of the switch means 19 in the store 21. Any other suitable biasing means can be employed.

The release means 31 has been illustrated hereinbefore by the fusible wire 31. Any of the more conventional release means may be employed. For example, solenoid operated latches disposed adjacent the top of the respective sides 25 and 27 can be employed, the solenoids being energized by closure of the switch 19 to allow the sides to fall away to expose the inner message board.

The inner message board has been illustrated by opaque sides with letters cut therein. Similarly as with the exterior sides 25 and 27, the inner message board may be comprised of translucent sides with the message displayed thereon in transparent or contrasting letters.

The flashers that are employed herein are conventional flashers that are readily available from lighting stores and do not require further description herein. Larger flashers can be employed for the entire bank of lights but have to be specially manufactured and is more expensive and less reliable than the plurality of individual flashers illustrated.

While the support has been illustrated by the pole 17, the support may comprise any suitable structure for supporting the sign 13 at the desired height and visibility. For example, structural protrusions from buildings may be employed. It is preferred that the sign 13 be disposed so as to not be directly visible from the interior of the store in order to prevent danger to clerical personnel and the like in the event of a robbery and the silent emergency inner message board is displayed.

From the foregoing, it can be seen that this invention obviates the disadvantages of the prior art and provides an advertising and emergency sign that doubles as a device for combating robbery, as a device for summoning aid, or such other purposes as may be desired.

Although this invention has been described with a certain degree of particularity, it is understood that the present disclosure has been made only by way of example and that numerous changes in the details of construction and the combination and arrangements of parts may be resorted to without departing from the spirit and the scope of this invention.

What is claimed is:

1. An advertising and emergency sign device comprising:

a. a sign disposed so as to be readily seen by passersby; said sign including:

i. a central framework;

ii. two facade sides, disposed one on each side so as to be normally seen in a normal configuration; said facade sides bearing a normal notation;

iii. retainer means for retaining said sides connected with said central framework at least in said normal position; said retainer means being connected respectively to said facade sides and said central framework and comprising respective hinge means hingedly connecting one edge each of respective said facade sides with said central framework such that said facade sides will pivot downwardly from said central framework;

IV. interior message board disposed interiorly of said facade sides and connected with said central framework; said interior message board having displayed on respective sides an emergency message asking the passerby to summon aid;

v. release means for releasing at least one edge of respective said facade sides to allow said facade sides to fall away sufficiently to expose said interior message board;

vi. switch means for energizing said release means; said switch means being disposed at a point remote from said sign so as to be closed when a robbery and the like is in progress making display of the emergency message desirable; such that said interior message board with its emergency message is exposed silently so as not to endanger person's lives in the event of a robbery and the like;

vii. interior illumination means for illuminating said interior message board; said interior illumination means being disposed interiorly of said central framework and adapted to remain energized after said release means is energized by closure of said switch means;

b. exterior illumination means for illuminating said sign in said normal configuration for viewing at night;

c. support means supporting said sign.

2. The advertising and emergency sign device of claim 1 wherein said facade sides are opaque and said exterior illumination means is disposed exteriorly of said interior message board, and also exteriorly of said facade sides.

3. The advertising and emergency sign device of claim 1 wherein said retainer means include respective limit means to limit the respective degrees of pivotal movement of respective said facade sides.

4. The advertising and emergency sign device of claim 1 wherein said release means includes electrically actuatable means disposed at respective edges of said facade sides opposite said hinge means.

5. The advertising and emergency sign device of claim 4 wherein biasing means for forcing initial movement of said facade sides are provided; said biasing means being disposed so as to store potential energy when said facade sides are closed such that initial pivotal movement is effected when said release means is energized by closure of said switch means to release said facade sides.

6. The advertising and emergency sign device of claim 1 wherein said interior message board comprises two oppositely disposed opaque sides with transparent letters formed therein and said interior illumination means comprises respective lights behind respective said letters.

7. The advertising and emergency sign device of claim 6 wherein said interior illumination means includes flasher means for flashing said lights and attracting attention of passersby to summon aid.

* * * * *